US007213733B1

(12) United States Patent
Wen

(10) Patent No.: US 7,213,733 B1
(45) Date of Patent: May 8, 2007

(54) NAIL GUN SWITCH MECHANISM FOR SWITCHING DUAL ACTUATION MODES

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/614,064

(22) Filed: Dec. 20, 2006

(51) Int. Cl.
*B25C 1/04* (2006.01)

(52) U.S. Cl. ..... 227/8; 227/142

(58) Field of Classification Search ..... 227/8, 227/130, 142, 136, 120
See application file for complete search history.

(56) References Cited

U.S. PATENT DOCUMENTS 4,629,106 A * 12/1986 Howard et al. ..... 227/8
5,551,621 A * 9/1996 Vallee ..... 227/8
5,669,541 A * 9/1997 Ronconi ..... 227/8
6,116,488 A * 9/2000 Lee ..... 227/8
6,419,140 B1 * 7/2002 Chen ..... 227/8
6,581,814 B1 * 6/2003 Hsu ..... 227/8
6,662,989 B1 * 12/2003 Chang et al. ..... 227/8
6,675,999 B2 * 1/2004 Mukoyama et al. ..... 227/8
6,886,729 B1 * 5/2005 Lee ..... 227/8
7,070,080 B2 * 7/2006 Lin ..... 227/8
7,137,540 B2 * 11/2006 Terrell et al. ..... 227/8
2005/0184120 A1 8/2005 Terrell et al.

* cited by examiner

*Primary Examiner*—Scott A. Smith

(57) ABSTRACT

A nail gun switch mechanism has a trigger valve bar received in a trigger of the nail gun; a trigger lever pivotally disposed on the trigger; a safety slidable bar pivotally disposed on a gun body; a longitudinal guiding hole formed at a peripheral side of the gun body; a shaft slidably received in the guiding hole; a switch bar arranged on the shaft, which the switch bar can bring the shaft to rotate in the longitudinally guiding hole; and a hitting base of the safety slidable bar extending out from an hitting mouth formed at a bottom portion of the gun body. The shaft has a bias pole disposed at a top portion thereof, which the bias pole can synchronously rotate with the shaft and can be reposited by the adjusting of the switch bar. The trigger lever has a shorter end portion; a longer end portion; and an opening.

16 Claims, 12 Drawing Sheets

NAIL GUN SWITCH MECHANISM FOR SWITCHING DUAL ACTUATION MODES

BACKGROUND

The present invention relates to a nail gun switch mechanism, and particularly to a nail gun switch mechanism for switching the nail gun operation in a sequential actuation mode, a contact actuation mode, or a holding actuation mode.

Actuating nails for a pneumatic nail gun generally can be divided into two kinds, one is the sequential actuation mode (or the restrictive mode) and the other is the contact actuation mode.

The sequential actuation mode means the operator firstly should set a safety slidable bar or a hitting base on the safety slidable bar contacting on a workpiece to push an upward movement of a trigger lever, and then press a trigger to bring the trigger lever to actuate a trigger valve. In this mode, if the operator wants to actuate again, he should release the trigger first, and then repeat the processes of pressing the trigger. If the operator disobeys the operating sequence, i.e. first pressing the trigger and then pressing the safety slidable bar or the hitting base of the safety slidable bar, the trigger lever in the trigger can not be brought to actuate the trigger valve and nails in the nail gun is held to be driven. Thus, no dangerous accidental shot happens when the safety slidable bar or the hitting base of the safety slidable bar is wrongly touched by somebody.

The contact actuation mode means the operator should first continuously press the trigger, and then move the safety slidable bar or the hitting base of the safety slidable bar on the workpiece to perform continuously contact hitting, which makes the trigger lever brought to upwardly move and actuates the trigger valve to continuous shot. In addition, the contact actuation mode also allows the operator first sets the safety slidable bar or the hitting base of the safety slidable bar on the workpiece to bring the trigger lever to upwardly move, and then individually or continuously presses the trigger to respectively actuate single or multiple nails for fastening the workpiece.

These two actuation modes are both used in a nail gun by utilizing a switch mechanism to realize switching of the sequential actuation mode and the contact actuation mode. As shown in U.S. Pub. No. 20050184120, a rotating rod is included in a contact safety assembly which is constructed to slide toward/away from a driver housing. The rotating rod includes a first shoulder or ledge and a second shoulder which is off-set from the first shoulder. The rod may be rotated in order to orientate the selected shoulder, to function as a step for a pivoting trigger assembly, which is constructed to contact a pneumatic valve, to initiate a fastening event in which a fastener is driven into a workpiece. The configuration of the rotating rod permits for selection between a contact actuation mode and a sequential actuation mode. However the mechanism can not permit a holding actuation mode, which makes the nail gun is easily to be wrongly actuated when the nail gun is set on something or is brought by somebody. Thus, accidentally dangerous shot easily happens.

BRIEF SUMMARY

An example nail gun switch mechanism of the present invention has a trigger valve bar received in a trigger of the nail gun; a trigger lever pivotally disposed on the trigger; a safety slidable bar pivotally disposed on a gun body; a longitudinal guiding hole formed at a peripheral side of the gun body between the safety slidable bar and the trigger; a shaft slidably received in the guiding hole; a switch bar arranged on the shaft, which the switch bar can bring the shaft to rotate in the longitudinally guiding hole; and a hitting base of the safety slidable bar extending out from an hitting mouth formed at a bottom portion of the gun body. The shaft has a bias pole disposed at a top portion thereof, and the bias pole can synchronously rotate with the shaft and can be reposited by adjusting the switch bar. The trigger lever has a shorter end portion formed at an end thereof, which can be pushed by the bias pole to actuate the trigger valve bar when the sequential actuation operates. In addition, a longer end portion is formed at the end of the trigger lever, which can be pushed by the bias pole to actuate the trigger valve bar when the contact actuation operates, and an opening is formed at the end, which does not receive the push of the bias pole.

The nail gun switch mechanism utilizes the trigger lever and bias pole to improve the safety ratio, whatever the nail gun is placed, taken, or in use. In addition, the nail gun switch mechanism is convenient in operation and has a lower manufacturing cost.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
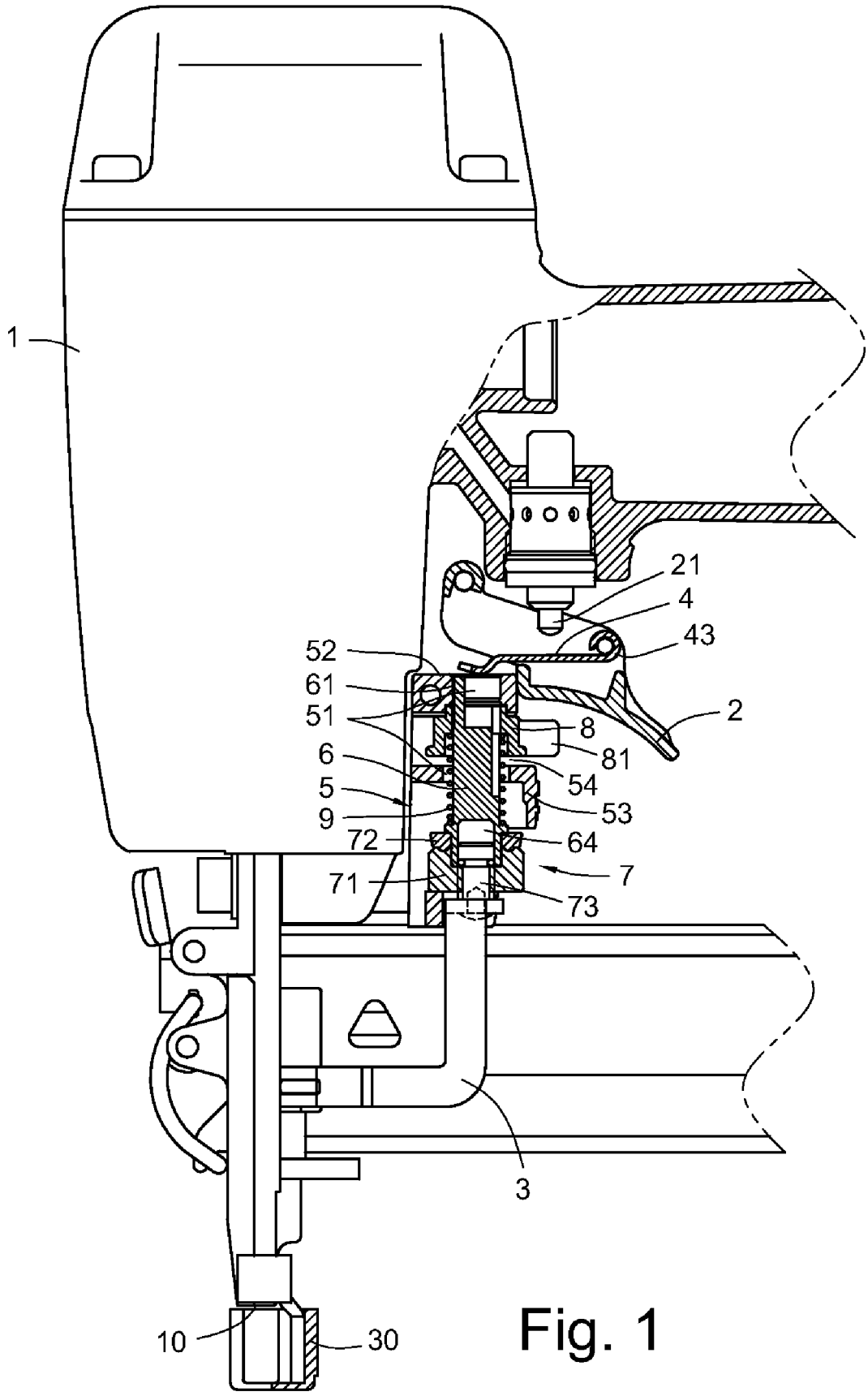
FIG. 1 is a schematic, partially cross-sectional view of a nail gun switch mechanism according to a first embodiment of the present invention.

FIG. 1 discloses a nail gun switch mechanism according to a first embodiment of the present invention. The nail gun switch mechanism has a trigger 2 and a safety slidable bar 3 pivotally disposed on a gun body 1. The nail gun switch mechanism further has a trigger valve bar 21 received in the trigger 2, a trigger lever 4 pivotally disposed thereon, a longitudinally guiding hole 51 formed at a peripheral side of the gun body 1 between the safety slidable bar 3 and the trigger 2, a shaft 6 slidably received in the longitudinally guiding hole 51 (as shown in FIGS. 2 to 3).

Figure 4:
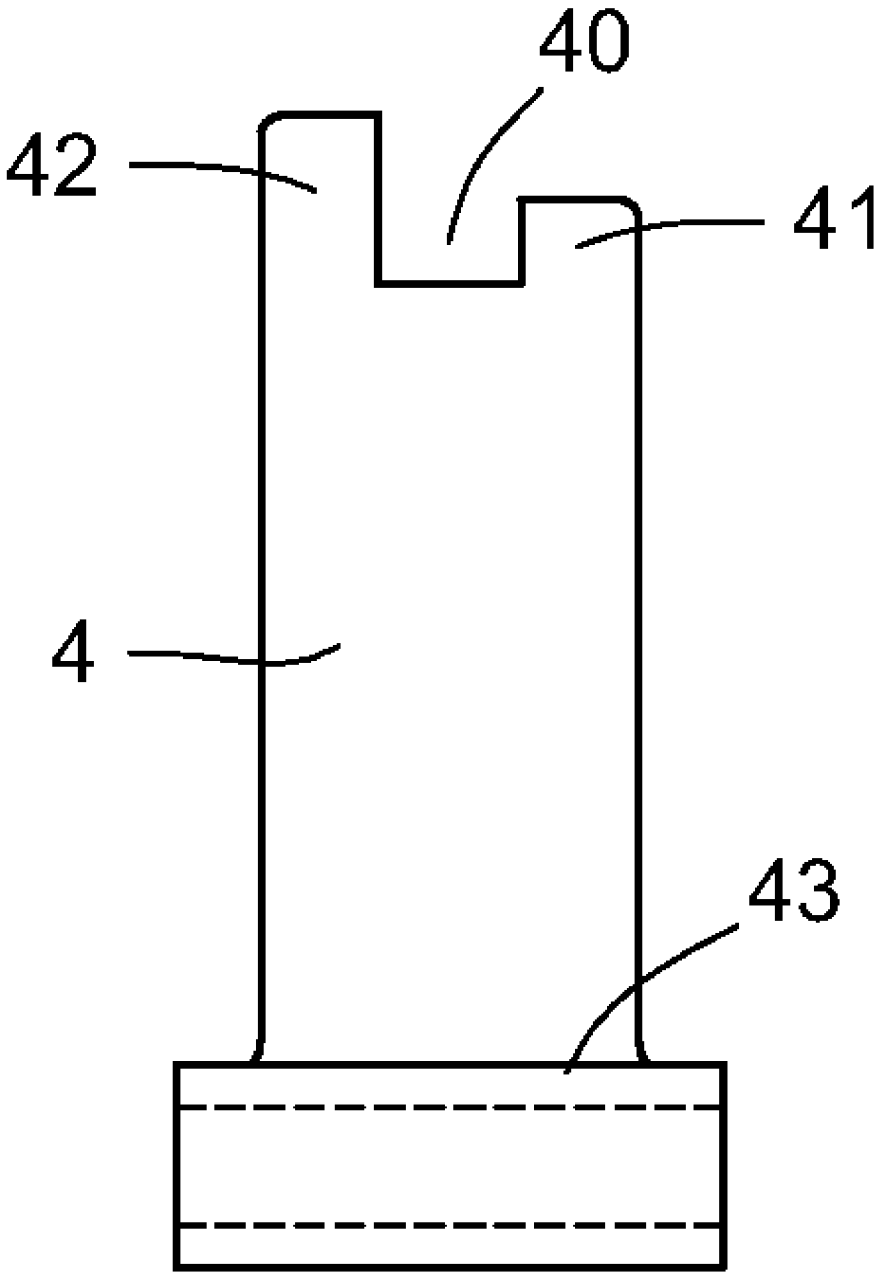
FIG. 4 is a front view of a trigger lever of the nail gun switch mechanism of FIG. 1.
Figure 7:
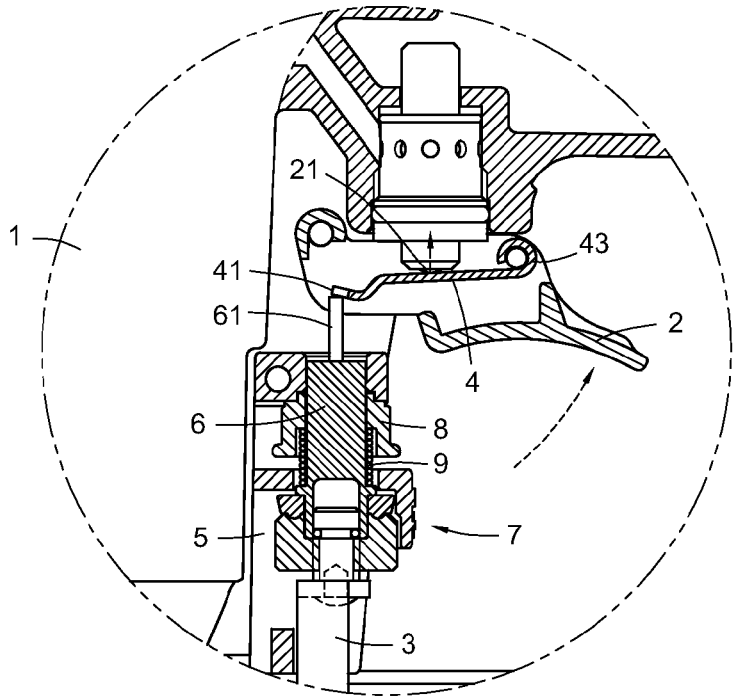
FIG. 7 is a schematic view disclosing another operation of the sequential actuation mode.

The trigger lever 4 has a pivot base 43 (as shown in FIG. 4) pivotally disposed on the trigger 2. When the trigger lever 4 is pushed or is brought to upwardly move (as shown in FIG. 7), an intermediate portion of the trigger lever 4 can push the trigger valve bar 21.

The safety slidable bar 3 has a bend shape (as shown in FIG. 1). One end of the safety slidable bar 3 connects with the shaft 6 (referring to FIGS. 2 and 3) through a hitting depth adjuster 7; another end of the safety slidable bar 3 connects with a hitting base 30 and extends out from an hitting mouth 10 formed at a bottom portion of the gun body 1. The nail gun switch mechanism further has a switch bar 81 arranged on the shaft 6, which the switch bar 81 can bring the shaft 6 to rotate in the longitudinally guiding hole 51.

Figure 2:
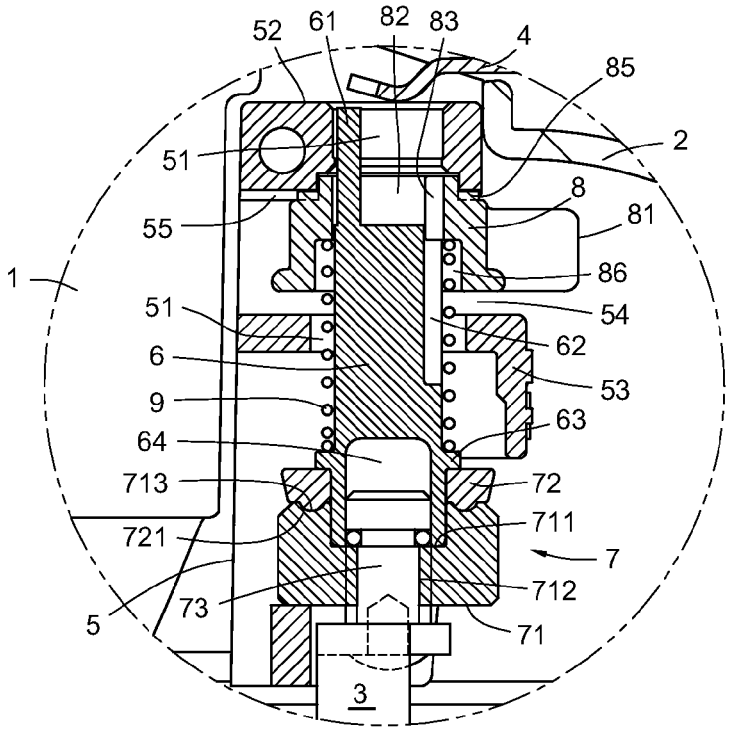
FIG. 2 is a partially enlarged view of the nail gun switch mechanism.
Figure 3:
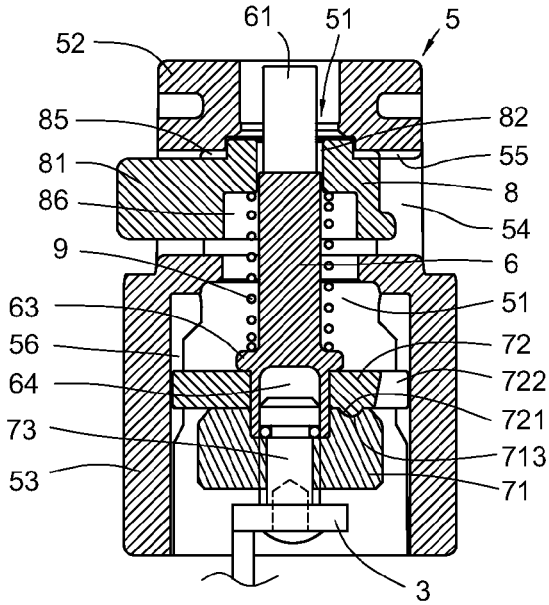
FIG. 3 is a cross-sectional view of the nail gun switch mechanism of FIG. 2.

The shaft 6 has a bias pole 61 (as shown in FIGS. 1 to 3) disposed at a top portion thereof, and the bias pole 61 can synchronously rotate with the shaft 6 and can be reposited by the adjustment of the switch bar 81.

Figure 5:
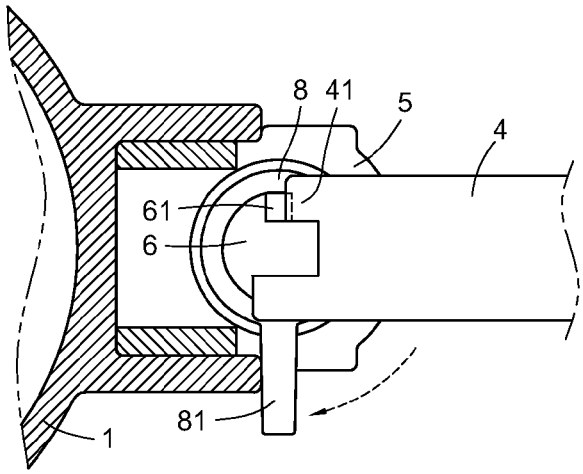
FIG. 5 is a top view of a base of the nail gun switch mechanism of FIG. 2.
Figure 6:
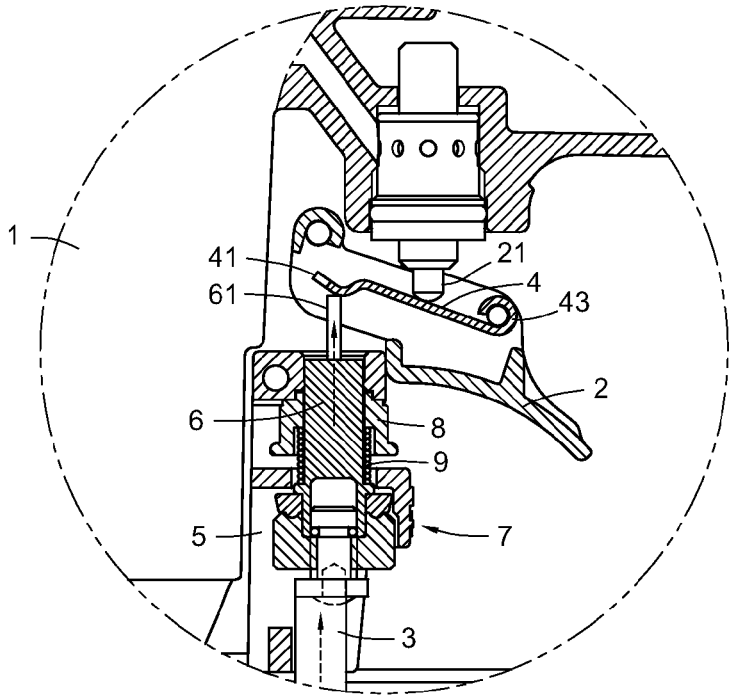
FIG. 6 is a schematic view disclosing an operation of a sequential actuation mode.

The trigger lever 4 (as shown in FIG. 4) has a shorter end portion 41 formed at an end, which can be pushed by the bias pole 61 when the nail gun operates in a sequential actuation mode (as shown in FIGS. 5 and 6).

Figure 10:
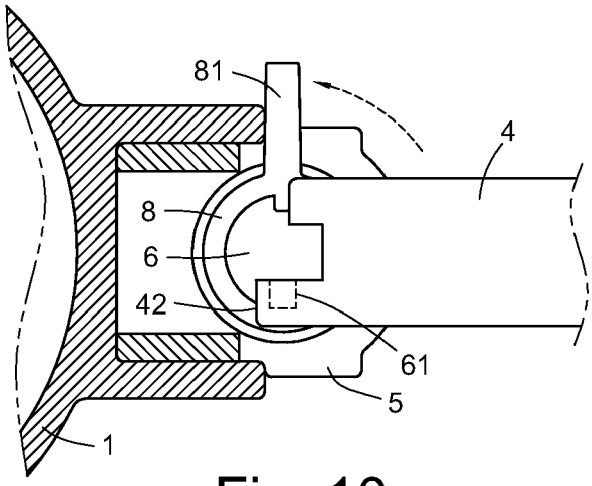
FIG. 10 is another top view of the base of the nail gun switch mechanism of FIG. 2.
Figure 11:
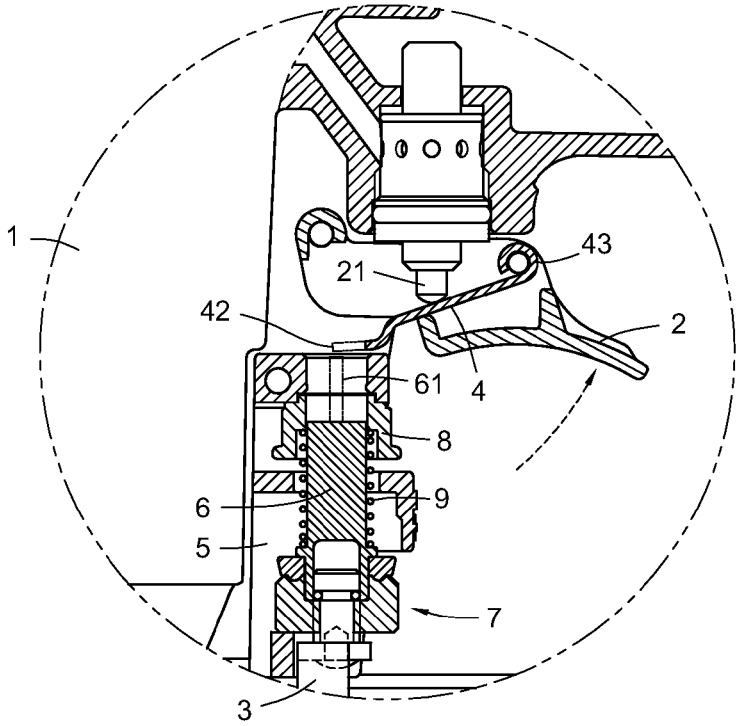
FIG. 11 is a schematic view disclosing an operation of a contact actuation mode.

The trigger lever 4 (as shown in FIG. 4) further has a longer end portion 42 formed at the end, which can be pushed by the bias pole 61 when the nail gun operates in a contact actuation mode (as shown in FIGS. 10 and 11).

Figure 15:
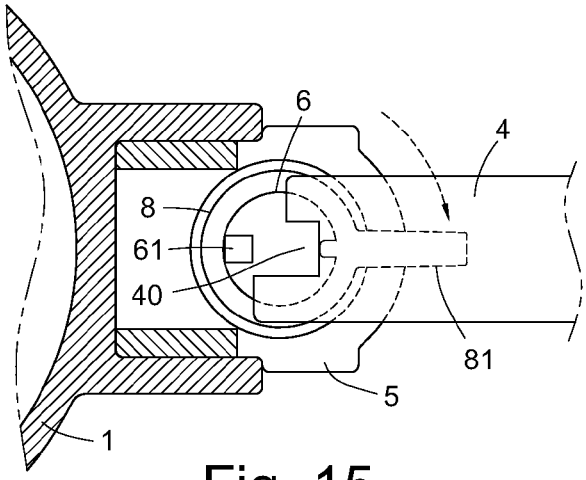
FIG. 15 is a further another top view of the base of the nail gun switch mechanism of FIG. 2.
Figure 16:
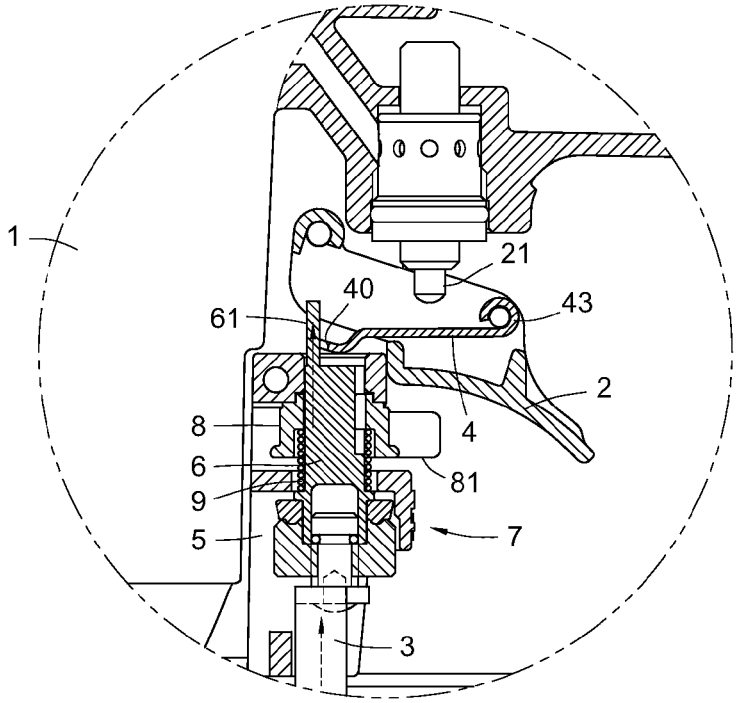
FIG. 16 is a schematic view disclosing an operation of a holding actuation mode.

The trigger lever 4 further has an opening 40 formed at the end, which does not receive the push of the bias pole 61 (as shown in FIGS. 15 and 16).

In addition, the nail gun switch mechanism further has a base 5 formed on an outer peripheral side of the gun body 1 between the trigger 2 and the safety slidable bar 3. The base 5 has a top base 52, a bottom base 53 and a single-side longitudinal opening groove 54 between the top base 52 and the bottom base 53. The top base 52 can have a plurality of longitudinal notches 55 formed at a bottom thereof.

The guiding hole 51 has a circular shape formed between the top base 52 and the bottom base 53 (as shown in FIGS. 2 and 3), which passes through a top end and a bottom end of the base 5.

The shaft 6 is a column, which has at least one longitudinal fillister 62 (as shown in FIG. 2) formed at a peripheral sidewall of the shaft 6. The longitudinal fillister 62 can be made like a slideway for nesting a switch button 8. The switch button 8 has a through hole 82 formed in a central portion thereof and at least one longitudinal protruding rib 83 formed at an inner peripheral surface of the switch button 8 thereon, where the at least one longitudinal protruding rib 83 can be slidably received in the longitudinal fillister 62 of the shaft 6.

The switch bar 81 can be formed on the switch button 8 (as shown in FIGS. 2 and 3), and the switch button 8 is a ring-shaped column and is received in the single-side longitudinal opening groove 54 of the base 5. In addition, the switch button 8 can further has a protrusion 85 formed at a shoulder portion thereof, in which the protrusion 85 matches with the plurality of longitudinal notches 55 for locating the switch button 8 at corresponding positions of the contact actuation mode, sequential actuation mode or holding actuation mode.

A spring 9 (as shown in FIG. 2) is provided between the shaft 6 and the switch button 8. The shaft 6 has a flange 63 (as shown in FIG. 3) at a peripheral outer surface for supporting the spring 9. Thus, the shaft 6 can move between the switch button 8 and the guiding hole 51 by the elastic deformation of the spring 9. In addition, the shaft 6 has a bottom hole 64 formed at a bottom center thereof.

The hitting depth adjuster 7 has a tooth bolt 73, a knob 71 and a stopper ring 72 (as shown in FIGS. 1 to 3). The tooth bolt 73 is formed on a top portion of the safety slidable bar 3, which is received in the bottom hole 64 of the shaft 6 and nested in the shaft 6 by the thrust of the spring 9.

The knob 71 is in a shape of screw cap, which has a slideproof peripheral surface for convenience of manual operation. The knob 71 has a concave circular groove 711 nesting on a bottom portion of the shaft 6, a tooth hole 712 nesting on the tooth bolt 73, a plurality of block grooves 713 formed on a top portion of the knob 71.

The stopper ring 72 has a ring shape with a vacant circular center, which is nested on a bottom portion of the flange 63 of the shaft 6 (as shown in FIG. 2). The stopper ring 72 has a plurality of protrusions 721 corresponding to the notches 713 of the knob 71, in which the protrusions 721 can slip between the notches 713 and be located in the notch 713. In addition, the stopper ring 72 has two protruding blocks 722 respectively formed at two sides thereof, in which the two protruding blocks 722 are slidably disposed at a longitudinal guiding groove 56 formed at two sides of a bottom portion of the base 5, for preventing the stopper ring 72 from rotating (as shown in FIG. 3). The operator can adjust position of the knob 71 on the tooth 73 for controlling a distance between the safety slidable bar 3 and the hitting base 30, which can realize the hitting depth adjustment.

The shorter end portion 41 of the trigger lever 4 is disposed at one side of the longer end portion 42 (as shown in FIG. 4) of the trigger lever 4, and the opening 40 is defined between the shorter end portion 41 and the longer end portion 42.

According to the aforementioned structure, the operation of the present invention is described as follows.

To set up the pneumatic nail gun in a sequential actuation mode, the operator can adjust the switch bar 81 (as shown in FIG. 5) of the switching button 8 to one side of the base 5 for rotating the bias bar 61 under the shorter end portion 41 of the trigger lever 4. At this moment, the operator must push the hitting base 30 at the bottom portion of the safety slidable bar 3 on a workpiece, which makes the hitting base 30 and the safety slidable bar 3 to move upwardly (as shown in FIG. 6), and bring the bias pole 61 to move upward and push the shorter end portion 41 of the trigger lever 4 through the hitting depth adjuster 7 and the shaft 6. After that, the operator can press the trigger 2 (as shown in FIG. 7) to bring an upward movement of the pivot base 43 of the trigger lever 4, which brings the trigger lever 4 to move upwardly to push the trigger valve bar 21, and actuate the pneumatic nail gun sequentially shoot.

Figure 8:
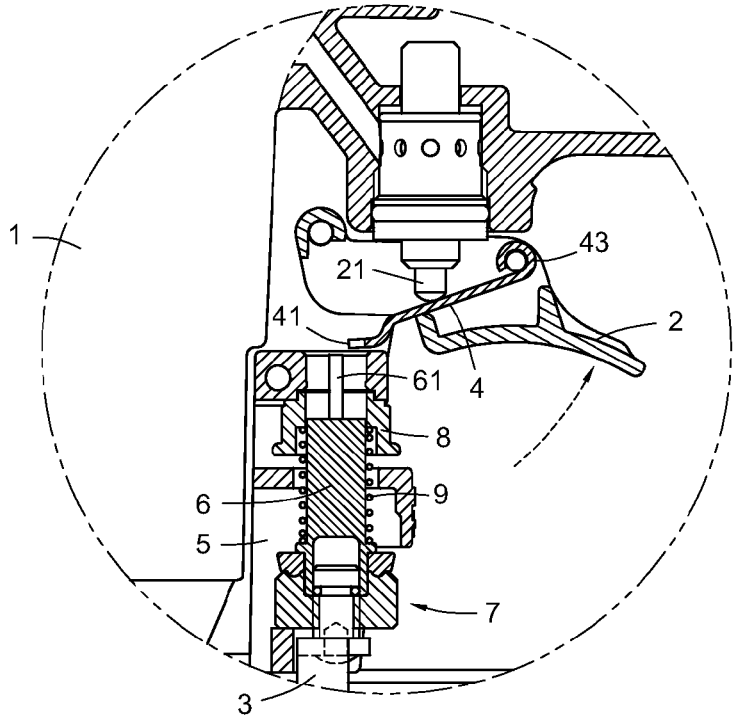
FIG. 8 is a schematic view disclosing a further another operation of the sequential actuation mode.
Figure 9:
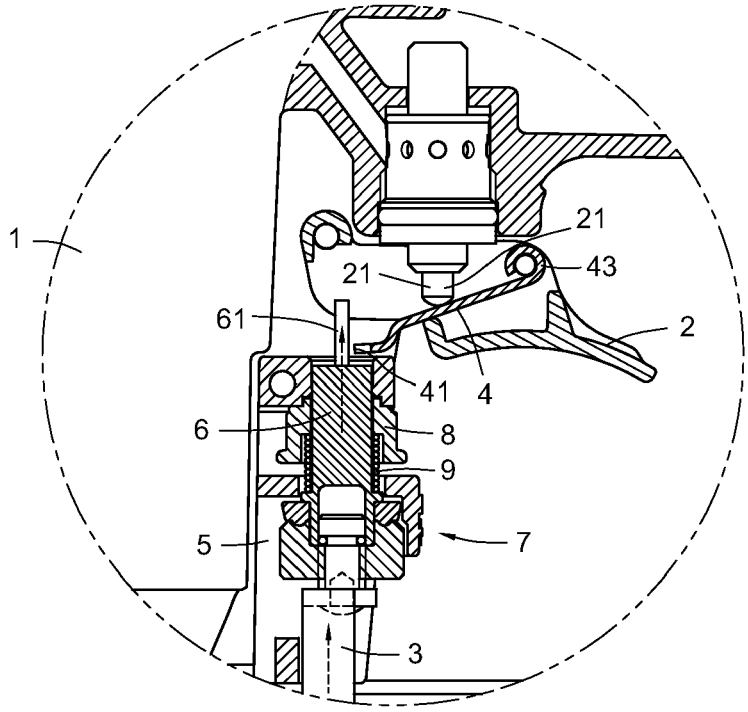
FIG. 9 is a schematic view disclosing further another operation of the sequential actuation mode.

In addition, if the operator wrongly operates, i.e. the operator firstly presses the trigger 2 (as shown in FIG. 8), and then pushes the hitting base 30 or the safety slidable bar 3 to bring the shaft 6 and the bias bar 61 to upwardly move (as shown in FIG. 9), no actuating event happens, because the pressed trigger 2 brings the trigger lever 4 to upwardly move, which makes the shorter end portion 41 of the trigger lever 4 away from a position that the bias bar 61 can reach. Thus, the trigger valve bar 21 can not be actuated. Therefore, a safety sequential actuation mode is realized.

Figure 12:
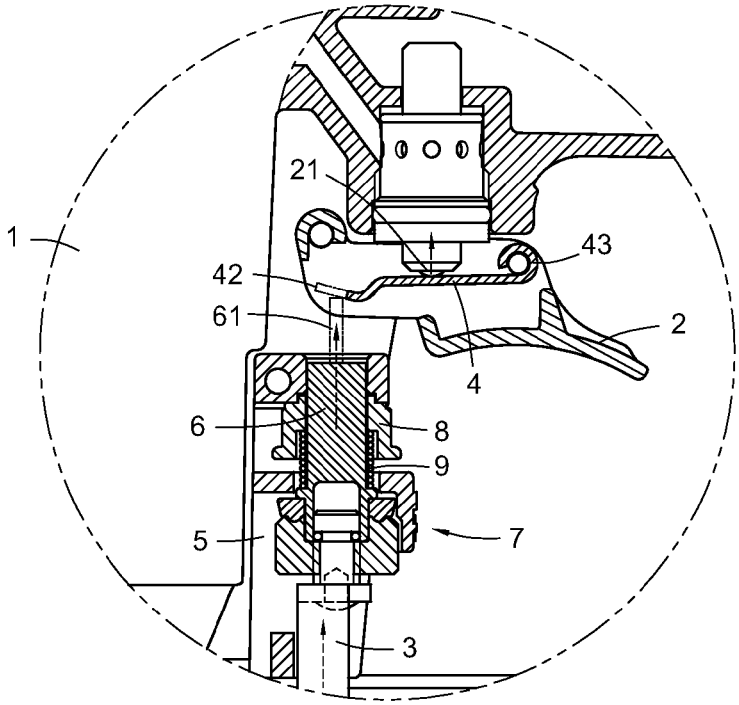
FIG. 12 is a schematic view disclosing an another operation of the contact actuation mode.

To set up the pneumatic nail gun in a contact actuation mode, the operator can adjust the switch bar 81 (as shown in FIG. 10) of the switching button 8 to another side of the base 5 for rotating the bias bar 61 under the longer end portion 42 of the trigger lever 4. At this moment, the operator can firstly press the trigger 2 to bring the pivot base 43 of the trigger lever 4 to upwardly move (as shown in FIG. 11), and then push the hitting base 30 at the bottom portion of the safety slidable bar 3 on a workpiece, which makes the hitting base 30 and the safety slidable bar 3 to move upwardly, and bring the bias pole 61 (as shown in FIG. 12) to move upwardly to push the longer end portion 42 of the trigger lever 4 through the hitting depth adjuster 7 and the shaft 6. The upward movement of the longer end portion 42 of the trigger lever 4 drives the trigger lever 4 to move upwardly to push the trigger valve bar 21, and actuates the pneumatic nail gun to work in the contact actuation mode. In this operation mode, the operator can press the trigger 2 continuously, or continuously repeat the actions of releasing and pressing the hitting base 30 to continuously push the longer end portion 42 of the trigger lever 4 through the bias bar 61. Thus, a continuous contact actuation mode can be attained.

Figure 13:
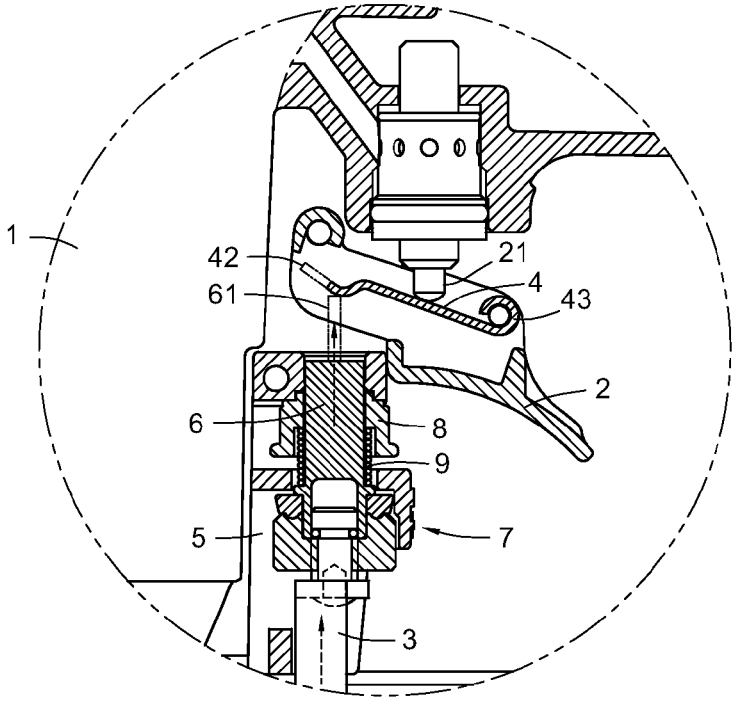
FIG. 13 is a schematic view disclosing further another operation of the contact actuation mode.
Figure 14:
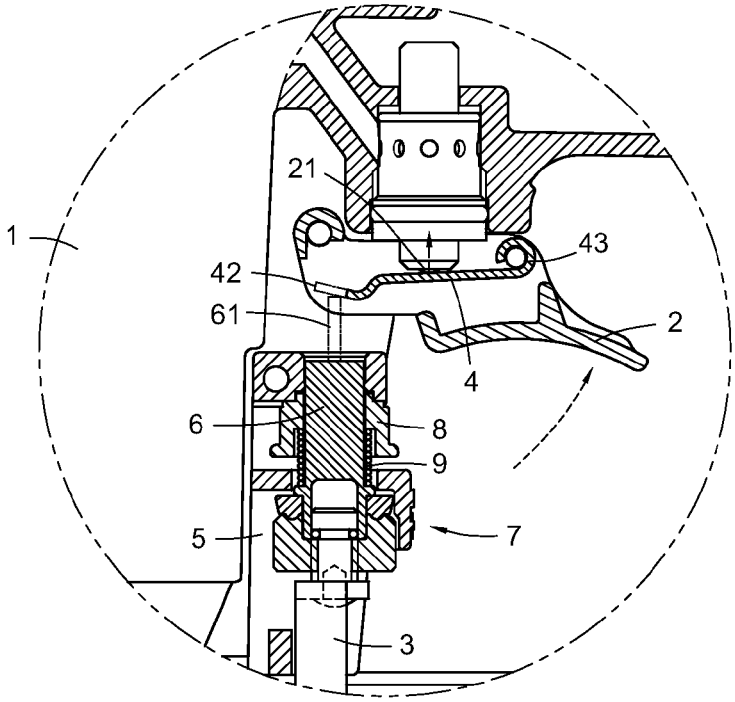
FIG. 14 is a schematic view disclosing further another operation of the contact actuation mode.

In addition, in the contact actuation mode, the operator also can firstly press the hitting base 30 on the workpiece to bring the safety slidable bar 3 to move upwardly and bring the bias pole 61 (as shown in FIG. 13) to move upwardly to push the longer end portion 42 of the trigger lever 4 through the hitting depth adjuster 7 and the shaft 6. And then, the operator can individually or continuously press the trigger 2 (as shown in FIG. 14) to conveniently actuate a single or a plurality of nails on the workpiece.

Figure 17:
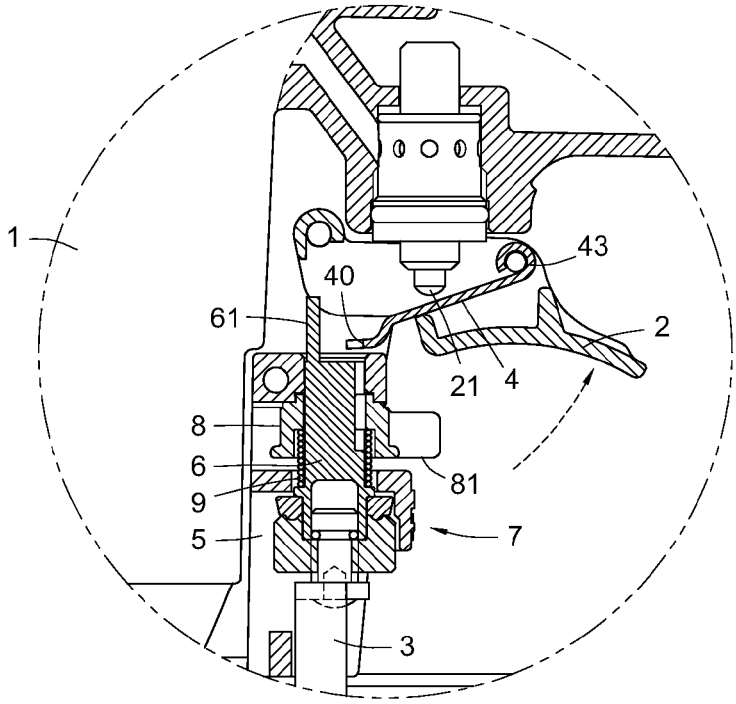
FIG. 17 is a schematic view disclosing another operation of the holding actuation mode.

To set up the pneumatic nail gun in a holding actuation mode, the operator can adjust the switch bar 81 (as shown in FIG. 15) of the switching button 8 ahead a center portion of the base 5 for rotating the bias pole 61 in the opening 40 of the trigger lever 4. If the operator wrongly operates the safety slidable bar 3 or the hitting base 30 to actuate the shaft 6 and the bias bar 61 to move upwardly (as shown in FIG. 16), the bias bar 61 passes through the opening 40 of the trigger lever 4. Thus, the trigger lever 4 can not be pushed by the upward bias bar 61 and keeps immovable. In addition, if the operator wrongly operates, i.e. the operator firstly presses the trigger 2 (as shown in FIG. 17), and then pushes the hitting base 30 or the safety slidable bar 3 to bring the shaft 6 and the bias bar 61 to upwardly move, also no danger actuating event happens because the upward bias bar 61 also can not touch the trigger lever 4. Therefore, the trigger valve bar 21 can not be wrongly actuated, and the safety ratio of the nail gun switch mechanism is improved, whatever the nail gun is placed, taken, or in use. In addition, the nail gun switch mechanism is convenient in operation and has a lower manufacturing cost.

Figure 18:
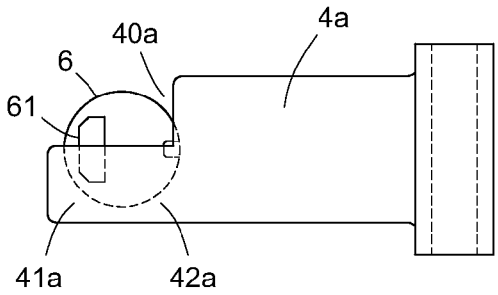
FIGS. 18 to 20 are front views of a trigger lever of a nail gun switch mechanism according to an alternative embodiment.
Figure 19:
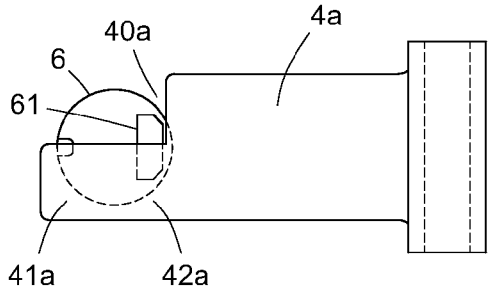
Figure 20:
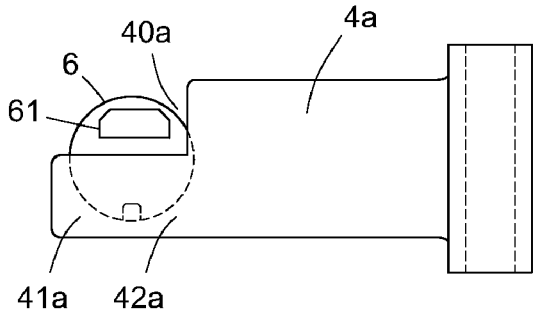
Figure 21:
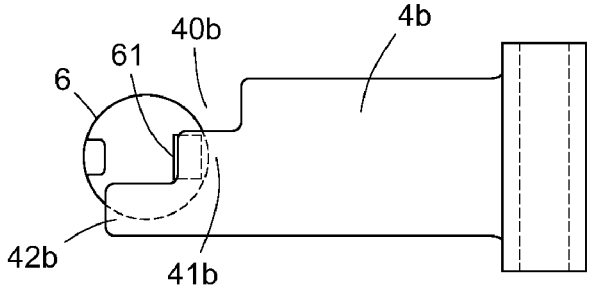
FIGS. 21 to 23 are front views of a trigger lever of a nail gun switch mechanism according to another alternative embodiment.
Figure 22:
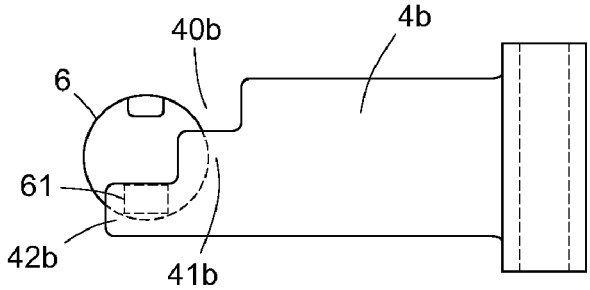
Figure 23:
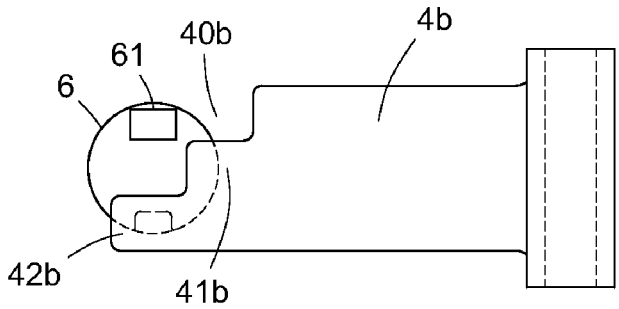

In a variation modification, a shorter end portion 41*a* can also be defined at a tail end of a longer end portion 42*a* (as shown in FIG. 18); an opening 40*a* is a cutout of the trigger lever 4*a* defined at a side of the longer end portion 42*a*, which can let the bias bar 61 to reposit under the shorter end portion 41*a*, the longer end portion 42*a* or the opening 40*a* (as shown in FIGS. 18 to 20). In another variation modification, an opening 40*b* is a cutout at a corner of a trigger lever 4*b* beside a longer end portion 42*b*, and a shorter end portion 41*b* is formed between the longer end portion 42*b* and the opening 40*b*, which can let the bias bar 61 to reposit under the shorter end portion 41*b*, the longer end portion 42*b*, or the opening 40*b* (as shown in FIGS. 21 to 23).

Figure 24:
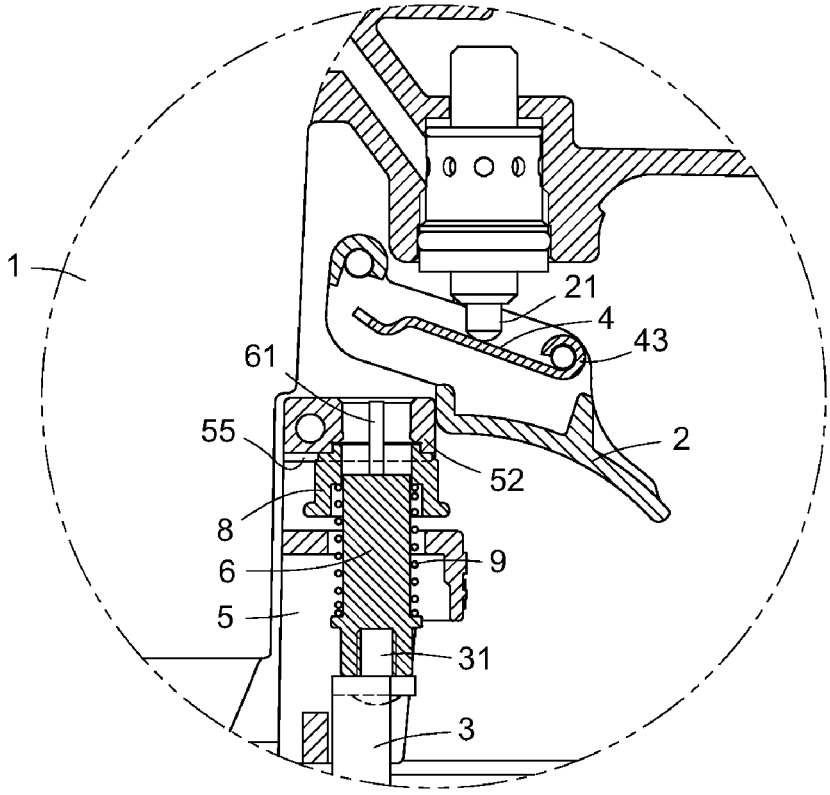
FIG. 24 is a cross-sectional view of a nail gun switch mechanism of the second embodiment of the present invention.

In another embodiment of the present invention, a nail gun switch mechanism can get rid of the hitting depth adjuster 7, which can utilize a screw 31 to fix the safety slidable bar 3 on the bottom portion of the shaft 6 (as shown in FIG. 24). The nail gun switch mechanism can also realize the switching operation between the sequential actuation mode, the contact actuation mode and the holding actuation mode.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A nail gun switch mechanism comprising:

a trigger valve bar received in a trigger of the nail gun;

a trigger lever pivotally disposed on the trigger;

a safety slidable bar pivotally disposed on a gun body;

a longitudinal guiding hole formed at a peripheral side of the gun body between the safety slidable bar and the trigger;

a shaft slidably received in the guiding hole;

a switch bar arranged on the shaft, which brings the shaft to rotate in the longitudinally guiding hole; and a hitting base of the safety slidable bar extending out from a hitting mouth formed at a bottom portion of the gun body;

wherein the shaft has a bias pole disposed at a top portion thereof, in which the bias pole can synchronously rotate with the shaft and can be reposited by adjusting the switch bar, and the trigger lever has a shorter end portion formed at an end thereof, which can be pushed by the bias pole to actuate the trigger valve bar when a sequential actuation operates, a longer end portion formed at the end, which can be pushed by the bias pole to actuate the trigger valve bar when a contact actuation operates and an opening formed at the end, which does not receive the push of the bias pole.

2. The nail gun switch mechanism as claimed in claim 1, further comprising a base formed on an outer peripheral side of the gun body between the trigger and the safety slidable bar.

3. The nail gun switch mechanism as claimed in claim 2, wherein the base has a top base, a bottom base and a single-side longitudinal opening groove between the top base and the bottom base.

4. The nail gun switch mechanism as claimed in claim 1, wherein the shaft has at least one longitudinal fillister formed at a peripheral sidewall of the shaft, in which the at least one longitudinal fillister is made like a slideway for nesting a switch button, and the switch bar is formed on the switch button.

5. The nail gun switch mechanism as claimed in claim 4, wherein the switch button has a through hole formed in a central portion thereof, and at least one longitudinal protruding rib formed at an inner peripheral surface of the switch button thereon, in which the at least one longitudinal protruding rib can be slidably received in the longitudinal fillister of the shaft.

6. The nail gun switch mechanism as claimed in claim 4, further comprising a spring provided between the shaft and the switch button, which makes the shaft to move between the switch button and the guiding hole by the elastic deformation of the spring.

7. The nail gun switch mechanism as claimed in claim 1, further comprising a base formed on an outer peripheral side of the gun body between the trigger and the safety slidable bar, in which the base has a top base, a bottom base and a single-side longitudinal opening groove between the top base and the bottom base; the single-side longitudinal opening groove receiving a switch button nested on the shaft, the switch bar being formed on the switch button.

8. The nail gun switch mechanism as claimed in claim 7, wherein the switch button has at least one protrusion formed at a shoulder portion thereof, which the at least one protrusion matches with a plurality of longitudinal notches formed at a bottom portion of the top base.

9. The nail gun switch mechanism as claimed in claim 7, further comprising a spring provided between the shaft and the switch button, which makes the shaft to move between the switch button and the guiding hole by the elastic deformation of the spring.

10. The nail gun switch mechanism as claimed in claim 9, wherein the shaft has a flange at a peripheral surface for supporting the spring.

11. The nail gun switch mechanism as claimed in claim 9, wherein the switch button has a spring groove formed at a bottom portion thereof for receiving a top portion of the spring.

12. The nail gun switch mechanism as claimed in claim 1, further comprising a hitting depth adjuster formed at a bottom end of the shaft to connect the safety slidable bar, the hitting depth adjuster having a tooth bolt formed on a top portion of the safety slidable bar for supporting the bottom end of the shaft, wherein a knob is nested on the tooth bolt.

13. The nail gun switch mechanism as claimed in claim 1, wherein the safety slidable bar connects with the bottom portion of the shaft through a screw.

14. The nail gun switch mechanism as claimed in claim 1, wherein the shorter end portion can also be defined at a tail end of the longer end portion; the opening is a cutout of the trigger lever defined at a side of the longer end portion.

15. The nail gun switch mechanism as claimed in claim 1, wherein the opening is a cutout at a corner of the trigger lever, beside the longer end portion, and the shorter end portion is formed between the longer end portion and the opening.

16. The nail gun switch mechanism as claimed in claim 1, wherein the opening is defined between the shorter end portion and the longer end portion.

* * * * *